United States Patent [19]

Lepisto

[11] 4,412,645

[45] Nov. 1, 1983

[54] SELF-SEALING BAG SLEEVE

[75] Inventor: J. George Lepisto, Middletown, Ohio

[73] Assignee: Champion International Corporation, Stamford, Conn.

[21] Appl. No.: 316,223

[22] Filed: Oct. 29, 1981

[51] Int. Cl.[3] ..... B65D 30/24

[52] U.S. Cl. ..... 383/48; 383/56

[58] Field of Search ..... 229/62, 62.5, 65; 150/9

[56] References Cited

U.S. PATENT DOCUMENTS

| | | | |
|---|---|---|---|
| 2,359,033 | 9/1944 | Gottwald | 229/62.5 |
| 2,517,068 | 8/1950 | Weeks | 150/9 |
| 3,894,682 | 7/1975 | Harmsen | 150/9 |
| 4,091,986 | 5/1978 | Eberle | 229/62.5 |
| 4,344,558 | 8/1982 | Newton et al. | 229/62.5 |
| 4,364,510 | 12/1982 | Buchanan | 229/62.5 |

*Primary Examiner*—George E. Lowrance
*Assistant Examiner*—Jimmy G. Foster
*Attorney, Agent, or Firm*—Evelyn M. Sommer

[57] ABSTRACT

In a bag adapted to contain a flowable product therein, the bag having first and second opposed closed ends, one of said ends having a self-sealing sleeve formed therein through which flowable product may be delivered into the bag, an improved self-sealing sleeve comprising a first generally tubular sleeve extending into said bag at one side of said one end, a second generally tubular sleeve located inside of and being attached to first sleeve and extending beyond the first sleeve into the bag and a third generally tubular sleeve located inside of and being attached to the second sleeve and extending beyond the second sleeve into said bag.

6 Claims, 9 Drawing Figures

SELF-SEALING BAG SLEEVE

BACKGROUND OF THE PRESENT INVENTION

The present invention relates generally to the packaging art and deals more particularly with an improved self-sealing filler sleeve for a flexible bag suitable for storing fine powdery materials and small size particle and granular products therein, and is of the type provided with a self closing sleeve valve to allow filling the bag with product. Heavy weight paper bags are frequently employed for containing, storing and shipping flowable, fine powdery materials and small sized granular products, such as starch, food products, chemicals, cement and the like. By virtue of the flowable character of these products, such bags are filled by inserting a filler spout of a dispensing machine into an opening of the bag, and the product is delivered from a source thereof through the spout into the bag. Many types of products packaged in this manner may contain dust, or are themselves "dusty" and the dust is easily suspended in the air during movement of the product, as during filling of the bag.

Because the dust from the products is easily suspended within the air, filling operations are sometimes messy, and can even present a health hazard to personnel due to the ambient air being polluted by the product. In addition, when the filled bags are being transported, the vibrations of the carrier, which may be a truck, train or the like, cause the fine powdery material to sift out through the filler opening part of the bag. Consequently, attemps to prevent sifting of the bags' contents through the valve have been made and special valves have been devised in the past to tightly fasten the filler openings of the bag to the dispensing spout during filling operations and to substantially prevent the escape of product from the bag once the dispensing spout is removed from the filler opening. In order to increase production efficiency, these prior art filler valves have been adapted to automatically seal the filler opening after the filling process has been completed.

Prior art bags of the type mentioned above comprise a tubular paper bag closed at both ends, at least one end having a plurality of flaps folded over to define a passageway in the end of the bag which presents an opening at one corner thereof. The flaps are hingedly interconnected to permit the bag to be folded into a flat condition wherein the walls defining the passageway collapse into a face-to-face abutting relationship. A flexible, tubularly shaped sleeve, formed of kraft paper and having a one mil, low density polyethylene film sleeve attached to the inside thereof and extending beyond said kraft paper sleeve is secured within the passageway and extends beyond the latter into the interior of the bag. The entire length of the sleeve is secured to, and between, overlapping flaps which form the closed end of the bag. The dispenser spout is inserted into the sleeve forming the valve and product is dispensed into the bag. After the bag is filled, it may or may not be inverted and the weight of the product in the bag presses against and squeezes the sleeve between opposing flaps thereby closing the sleeve and, thus, the valve.

The primary problem associated with the prior art bags of the type described above is related to the fact that the sleeve valve used in such bags was not "sift-proof" with respect to the product; i.e. the fine powdery material and small sized product within the bag had a tendency to sift out around and through the sleeve thereby escaping from the bag. This was due in part to the fact that wrinkles in the sides of the plastic sleeve were created by the filling operation. These wrinkles formed channels on both sides of the walls of the sleeve through which the product could escape.

Accordingly, it is an object of the present invention to provide an improved filler sleeve for flexible bags which permits filling of the bag with product but which are automatically closable to eliminate the problem of sifting of the product through the sleeve after the bag is filled.

Another object of the present invention is to provide an improved filler sleeve having a sleeve through which the bag may be filled with product and yet which sleeve completely closes after the filling operation in order to positively close the filler passageway through the sleeve and prevent sifting of the product through the sleeve after the bag is filled.

SUMMARY OF THE INVENTION

Thus, the present invention relates to an improved filler sleeve for a bag adapted to contain a flowable product therein, said bag having first and second opposed closed ends, one of said ends having a self-sealing sleeve formed therein through which flowable product may be delivered into said bag, said improved self-sealing filler sleeve comprising a first generally tubular sleeve extending into said bag at one side of said one end, a second generally tubular sleeve located inside of and being attached to said first sleeve and extending beyond said first sleeve into said bag and a third generally tubular sleeve located inside of and being attached to said second sleeve and extending beyond said second sleeve into said bag.

BRIEF DESCRIPTION OF THE DRAWINGS

These and other objects and advantages of the present invention will be disclosed in the course of the following specification, reference being had to the accompanying drawings in which like components are designated by like reference numerals in the various views and in which.

DETAILED DESCRIPTION OF THE INVENTION

Figure 1:
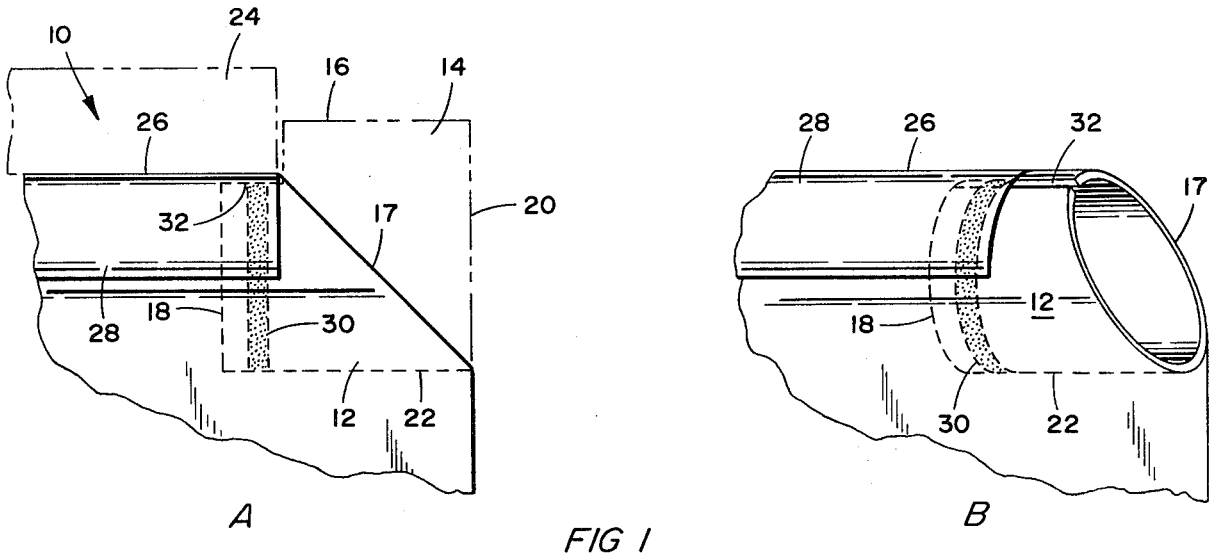
FIG. 1A is a partial side view of a corner of a bag with a first generally tubular sleeve formed from sides of the bag and extending into the bag.
FIG. 1B is a partial isometric view of the bag shown in FIG. 1A.

FIG. 1A is a partial side view of the corner of a bag generally denoted as 10 in its folded state with a first generally tubular sleeve 12 extending into said bag at one side of said one end. Tubular sleeve 12 is formed by folding the side flaps 14 (shown in dotted lines) inwardly about fold line 17 until they are lying inside the bag. Thus top side 16 becomes the inner end 18 of the first tubular sleeve 12 when it is tucked inside the bag. Outer edge 20 becomes bottom edge 22 when the sleeve is formed inside the bag. Outer flap 24 is folded about fold line 26 to form the overlapping flap 28 which is glued to hold the bag sealed in the position shown in FIG. 1A. Strip 30 indicates the area for a glue strip on tubular sleeve 12 to which the second generally tubular sleeve 34 shown in FIG. 2 will be glued to hold the second tubular sleeve 34 in place. Thus by folding outer edge 20 of one side of one end of the bag 10 inwardly about hinge line 17, a first generally tubular sleeve 12 is formed. It is, of course, open at the top 32 but that opening will be closed when the second generally tubular sleeve 34 shown in FIG. 2 is attached to sleeve 12 as hereinafter described. FIG. 1B is an isometric view of the partial corner of bag 10 shown in FIG. 1A better illustrating the first generally tubular sleeve formed when the outer edge 20 is folded inwardly about fold line 17 as previously described.

Figure 2:
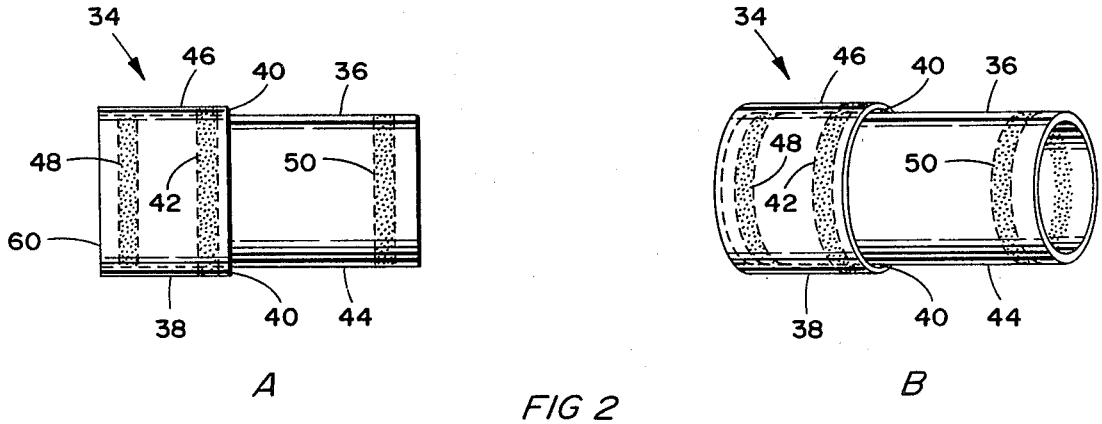
FIG. 2A is a side view of the second generally tubular sleeve which is to be placed inside of and attached to the first sleeve shown in FIG. 1A and FIG. 1B.
FIG. 2B is an isometric view of the second sleeve shown in FIG. 2A.
Figure 3:
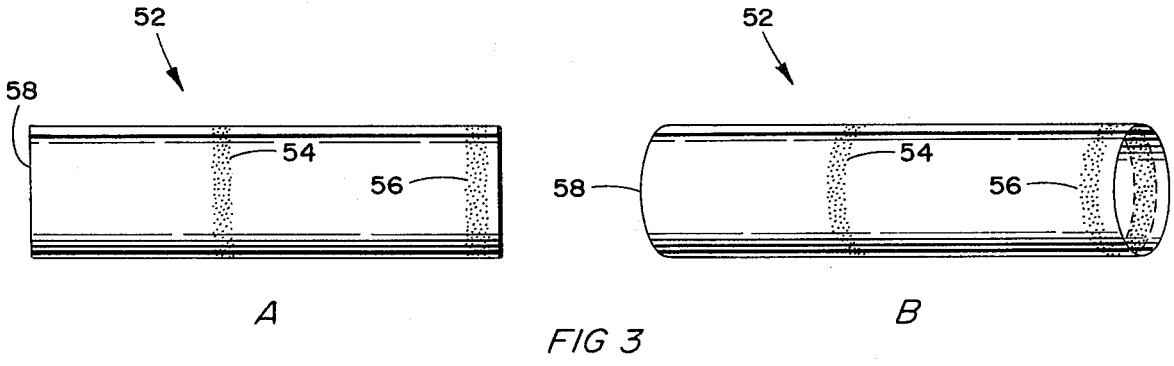
FIG. 3A is a side view of the third generally tubular sleeve which is to be placed inside of and attached to said second sleeve shown in FIG. 2A and FIG. 2B and extending beyond said second sleeve into said bag.
FIG. 3B is an isometric view of the third sleeve shown in FIG. 3A.
Figure 4:
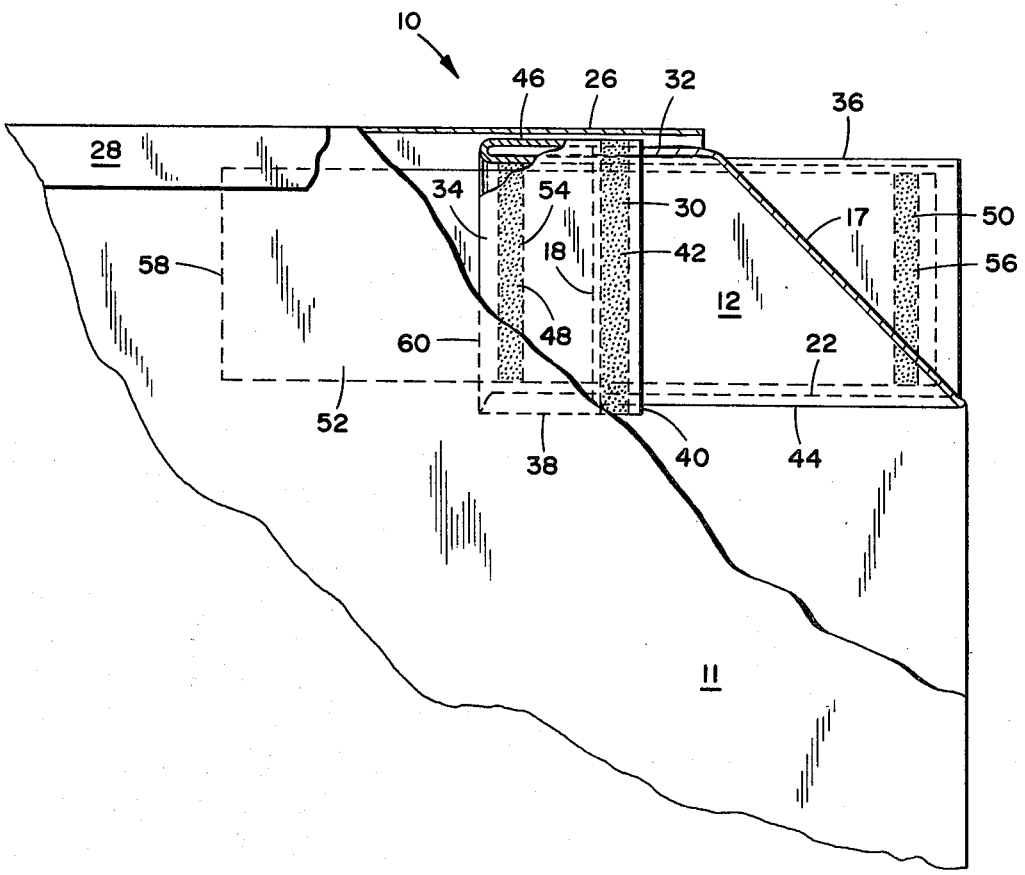
FIG. 4 is a partial side view of a portion of a bag with portions illustrated in section having the novel improved filler sleeve formed therein with the first, second and third generally tubular sleeves.

FIG. 2A is a side view of the second generally tubular sleeve indicated generally by the numeral 34 which comprises a cylinder 36 preferably made from kraft paper with one end 38 folded back on itself to form a U-shape 40 into which the first tubular sleeve 12 shown in FIG. 1 may be placed and glued. Thus glue strip 42 which is placed on the inside of the U-shape 40 mates with glue strip 30 in FIG. 1 as end 18 of first tubular sleeve 12 slides over outer end 44 of second tubular sleeve 34 and into the U-shaped portion 40 thereof. Outer surface 46 of the U-shaped portion 40 covers the open area 32 on first tubular sleeve 12. Folded back end portion 38 of sleeve 34 extends inside the bag as shown in FIG. 4. Areas 48 and 50 represent the areas on which glue may be placed inside of second generally tubular sleeve 34 and by which the third tubular sleeve 52 shown in FIG. 3 will be attached thereto.

FIG. 2B is an isometric view of the second generally tubular sleeve 34 showing more clearly how lower end 38 is folded back on itself to form a U-shaped section 40.

FIG. 3A is a side view of the third generally tubular sleeve 52 which is preferably made of polyethylene having a thickness of approximately 1 mil or less and which has thereon areas 54 and 56 for receiving a glue whereby third tubular sleeve 52 may be placed inside of and attached to second tubular sleeve 34 shown in FIG. 2 at glue strips 48 and 50.

FIG. 3B is an isometric view of the third tubular sleeve 52 illustrating the glue strip 54 and 56 where the sleeve 52 would be attached to second tubular sleeve 34 at glue strips 48 and 50 as shown in FIG. 2.

Figure 5:
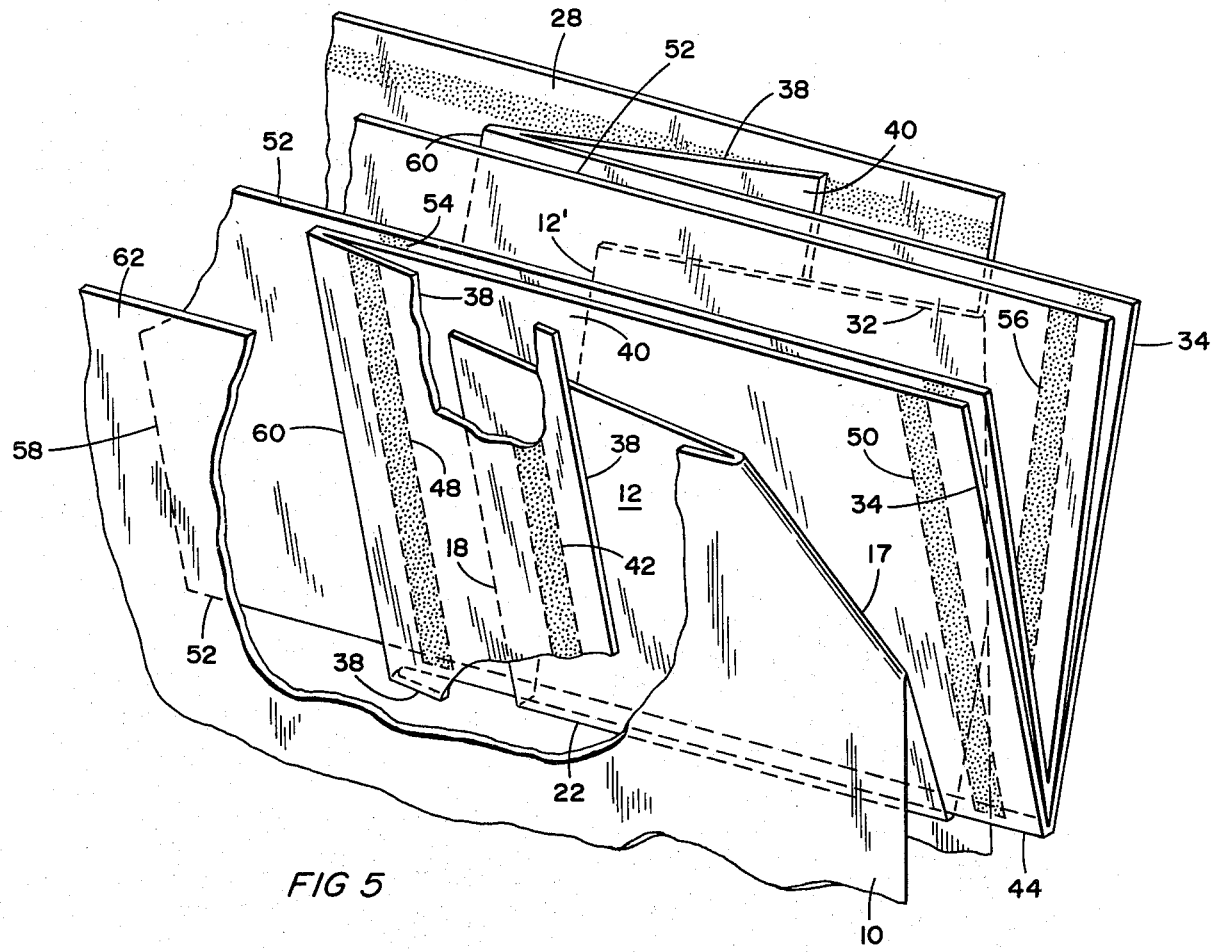
FIG. 5 is a partial isometric view of a bag corner having a sleeve formed therein.

A partial isometric view showing the entire assembled sleeve with parts thereof exposed is illustrated in FIG. 5. Thus the end 18 of first generally tubular sleeve 12 is placed in U-shaped portion 40 of second generally tubular shaped sleeve 34 and glued at strips 30 and 42 which overlap each other. Third generally tubular shaped sleeve 52 is then placed inside of second generally tubular shaped sleeve 34 and is glued thereto at overlapping strips 48 and 54 and 50 and 56. It will be noted that end 58 of third generally tubular shaped sleeve 52 extends beyond the end 60 of second tubular shaped sleeve 34 and well into the bag.

Figure 6:
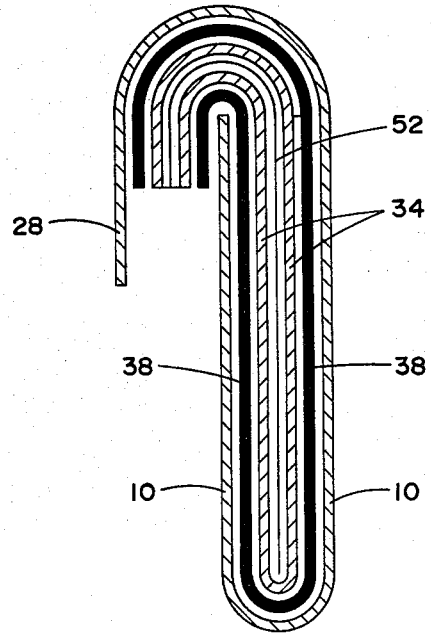
FIG. 6 is a cross-sectional view of a bag corner to illustrate construction details.

One method of constructing the novel sift proof sleeve is illustrated in FIGS. 5 and 6. As can be seen in FIG. 5, the bag 11, in its opened condition, may have one corner folded inwardly about line 17 to form flaps 12 and 12' projecting inwardly into the bag. Next, the polyethylene sheet 52 which will finally result in third generally tubular sleeve 52 may be folded and placed inside of kraft paper sheet 34 which is folded about line 44 and which also has one end 38 folded backwards on itself about line 60. By having one end 38 folded back on itself about line 60, a U-shaped channel 40 is formed which slides over both sides of panels 12 which are folded inwardly about line 17 of bag 10. By folding flap 28 of bag 10 and the upper edges of kraft paper sheet 34 and polyethylene sheet 52 over the upper edge 62 of the other side of bag 10 and have the flap 28 glued to upper edge 62 of bag 10, the entire sleeve is formed in the bag 10 during construction of bag 10 and sealing of the end thereof.

FIG. 6 illustrates a cross-sectional view of the upper edge 28 of bag 10 folded over with the kraft sheet 34 and the polyethylene sheet 52 folded under it. Edge 28 may then be glued to bag 10 to hold the entire construction in place.

From the foregoing, it is apparent that the improved sleeve of the present invention not only provides for the reliable accomplishment of the objects of the invention but does so in a particularly effective and economical manner. It is recognized, of course, that those skilled in the art may make various modifications or additions to the preferred embodiment chosen to illustrate the invention without departing from the spirt and scope thereof. Accordingly, it is to be understood that the protection sought and to be afforded hereby should be deemed to extend to the subject matter claimed and all equivalents thereof within the scope of the invention.

I claim:

1. In a bag having opposed side walls for containing a flowable product therein, the bag also having first and second opposed closed ends, one of said ends having a self-sealing sleeve formed therein through which flowable product may be delivered into the bag, the improvement comprising said self-sealing sleeve including:

a. a first generally tubular sleeve formed by folding one side of said one end of said bag inwardly so that the opposed side walls of said bag extend into said bag at said one side of said one end, b. a second generally tubular support sleeve located at least partially inside of said first sleeve, one end of said second tubular sleeve being folded back on itself to form a U-shape into which said first tubular sleeve is placed and adhesvely attached in a strip along the entire width thereof, and c. a third generally tubular sleeve of substantially reduced thickness and greater flexibility than said second sleeve adhesively attached inside of said second sleeve along two spaced parallel strips extending across the entire width of said third sleeve, the third sleeve extending in length beyond the end of said second sleeve into the interior of said bag between said opposed side walls, wherein said second tubular sleeve and said third tubular sleeve extending beyond said second tubular sleeve are held in place by closing and sealing said one end of said bag over said second and third sleeves.

2. An improved self-sealing sleeve as in claim 1 wherein said second tubular sleeve is formed of kraft paper.

3. An improved self-sealing sleeve as in claim 2 wherein said third tubular sleeve is formed of polyethylene and is glued to the inside of said second tubular sleeve.

4. An improved self-sealing sleeve as in claim 1 wherein said second tubular sleeve is formed of kraft paper.

5. An improved self-sealing sleeve as in claim 4 wherein said third tubular sleeve is formed of polyethylene.

6. An improved self-sealing sleeve as in claim 1 wherein said third sleeve is located and attached inside of said second sleeve.

* * * * *